US005979412A

United States Patent [19]

Werner

[11] Patent Number: 5,979,412

[45] Date of Patent: Nov. 9, 1999

[54] INDUCTIVE DISCHARGE INJECTOR DRIVER

[75] Inventor: Matthew L. Werner, Caro, Mich.

[73] Assignee: Walbro Corporation, Cass City, Mich.

[21] Appl. No.: 08/909,964

[22] Filed: Aug. 12, 1997

[51] Int. Cl.[6] ..... F02B 3/00; F02B 51/00

[52] U.S. Cl. ..... 123/490

[58] Field of Search ..... 123/490; 327/110, 327/326, 434; 307/104; 361/155, 156

[56] References Cited

U.S. PATENT DOCUMENTS

| | | | |
|---|---|---|---|
| 3,643,129 | 2/1972 | Marsh | 317/11 R |
| 4,327,693 | 5/1982 | Busser | 123/490 |
| 4,355,619 | 10/1982 | Wilkinson | 123/490 |
| 4,604,675 | 8/1986 | Pflederer | 361/155 |
| 4,905,120 | 2/1990 | Grembowicz et al. | 123/490 |
| 4,950,974 | 8/1990 | Pagano | 123/490 |
| 5,532,526 | 7/1996 | Ricco et al. | 123/490 |
| 5,793,232 | 8/1998 | Gallinari et al. | 327/110 |

FOREIGN PATENT DOCUMENTS 0366622 2/1990 European Pat. Off. .

*Primary Examiner*—Willis R. Wolfe
*Assistant Examiner*—Mahmoud M. Gimie
*Attorney, Agent, or Firm*—Reising, Ethington, Barnes, Kisselle, Learman & McCulloch, P.C.

[57] ABSTRACT

A drive circuit for energizing an engine fuel injector coil from a power source which has energy storage means responsive to a first control signal for selectively storing energy from the power source, and means responsive to a second control signal for selectively discharging energy stored in the energy storage means into said injector coil. The stored energy is discharged into the injector coil in addition to energy from the power source, to more rapidly open the fuel injector. In a preferred embodiment, the circuit has an inductor in circuit with the fuel injector, an inductor driver switch to control the flow of current through the inductor and an injector driver switch to control the flow of current through the fuel injector. When the inductor is energized by its associated switch, it stores significant electromagnetic energy therein, which is transferred to the injector when it is desired to open the injector to deliver an increased current to the injector to more quickly open it and reduce the start delay time for the injection event.

12 Claims, 2 Drawing Sheets

INDUCTIVE DISCHARGE INJECTOR DRIVER

FIELD OF THE INVENTION

This invention relates to fuel injectors and more particularly to an improved circuit for controlling the operation of a fuel injector.

BACKGROUND OF THE INVENTION

It is well known to use electronic fuel injectors to supply the fuel demands of an automotive engine. Typical automotive engines use one of two types of injectors, commonly referred to as "saturation" and "peak and hold" injectors. The performance of these fuel injectors is generally sufficient for an automotive, four-stroke engine or for crankcase scavenged two-stroke engines where both the air and fuel delivered to the engine are passed through the crankcase. With those types of engines, the duration of the injection event is longer than that of a directly injected two-stroke engine.

In a directly injected two-stroke engine, the fuel injector is typically placed in communication with the combustion chamber through either a cylinder wall or the cylinder head. Thus, fuel is supplied directly from the fuel injector to the combustion chamber which greatly limits the time available to complete the injection event. The injection event is further limited in a two-stroke engine as compared to a four-stroke engine because of the high revolutions per minute (RPM) at which a two-stroke engine may operate, with a typical maximum RPM of a two-stroke engine at about 12,000 RPM'S. Still further, in a two-stroke engine the injection event occurs with every revolution of the crankshaft as compared to every other revolution in a four-stroke engine. These limitations provide a total available injection time of about 3 milliseconds or less at high engine speeds. The current electrical circuits used to drive the fuel injectors have a relatively long start delay which is the time required to open the fuel injector after the electrical signal has been sent to the injector to open it. With the limited available injection time, it is desirable if not necessary to minimize the start delay time to insure that adequate fuel can be delivered to the engine at high engine speeds and loads wherein the engine demands a high quantity of fuel. While peak and hold type injectors have reduced the start delay time as compared to saturation injectors, a relatively long start delay time remains and the high voltage power supply required by some peak and hold circuitry is expensive.

SUMMARY OF THE INVENTION

A drive circuit for energizing an engine fuel injector coil from a power source which has energy storage means responsive to a first control signal for selectively storing energy from the power source, and means responsive to a second control signal for selectively discharging energy stored in the energy storage means into said injector coil. The stored energy is discharged into the injector coil, in addition to the energy from the power source, to more rapidly open the fuel injector.

In a preferred embodiment, the circuit has an inductor in circuit with the fuel injector, an inductor driver switch to control the flow of current through the inductor and an injector driver switch to control the flow of current through the fuel injector. When the inductor is energized by its associated switch, it stores significant electromagnetic energy therein, which is transferred to the injector when it is desired to open the injector to deliver an increased current to the injector to more quickly open it and reduce the start delay time for the injection event. In one embodiment, when the injector driver switch is off and the fuel injector is closed, the inductor driver switch is turned on and the inductor, which is connected in series with the injector, is energized or charged to provide the current boost to the fuel injector when the injector driver switch is subsequently closed. With this relatively simple circuitry, the start delay time of the fuel injection event is greatly reduced thereby permitting increased fuel flow through the injector to insure adequate fuel delivery to the engine even during high engine speeds and loads.

In an alternate embodiment, a pair of parallel energy paths are provided to the injector, one through the inductor and one parallel to the inductor. This allows energy to be stored in the inductor even when the injector switch is closed to insure that the inductor is adequately charged even under high engine speeds and loads wherein the fuel injector needs to be held open longer to deliver sufficient fuel to the engine. This increases the rate at which the cycle of storing energy in the inductor and discharging that energy to the injector may be repeated. This embodiment permits a simultaneous current flow to energize the inductor and actuate the injector, does not affect the injector performance, and greatly reduces the minimum time for the inductor to be precharged and to discharge that current to the fuel injector.

The rate at which this cycle of the drive circuit is repeated can be further improved by increasing the flow rate of the injector hence leading to a reduced injection time and more time to directly energize the inductor, or by using a lower resistance inductor which would require a shorter precharge time. The driver switches and the inductor as well as appropriate protection diodes are commonly available and of relatively low cost such that the entire circuit is considerably less expensive than peak and hold fuel injector circuits.

Objects, features and advantages of this invention include providing a fuel injector driver circuit to rapidly open the fuel injector which provides a significant reduction in the start delay time for the injection event, an increased current at the fuel injector to more quickly open it, a relatively simple circuit of commonly available components, and a driver which can be used with high impedance fuel injectors, does not require a high voltage supply, is significantly less expensive than current peak and hold injector drivers, is of economical manufacture and assembly, is reliable and has a long useful life in service.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
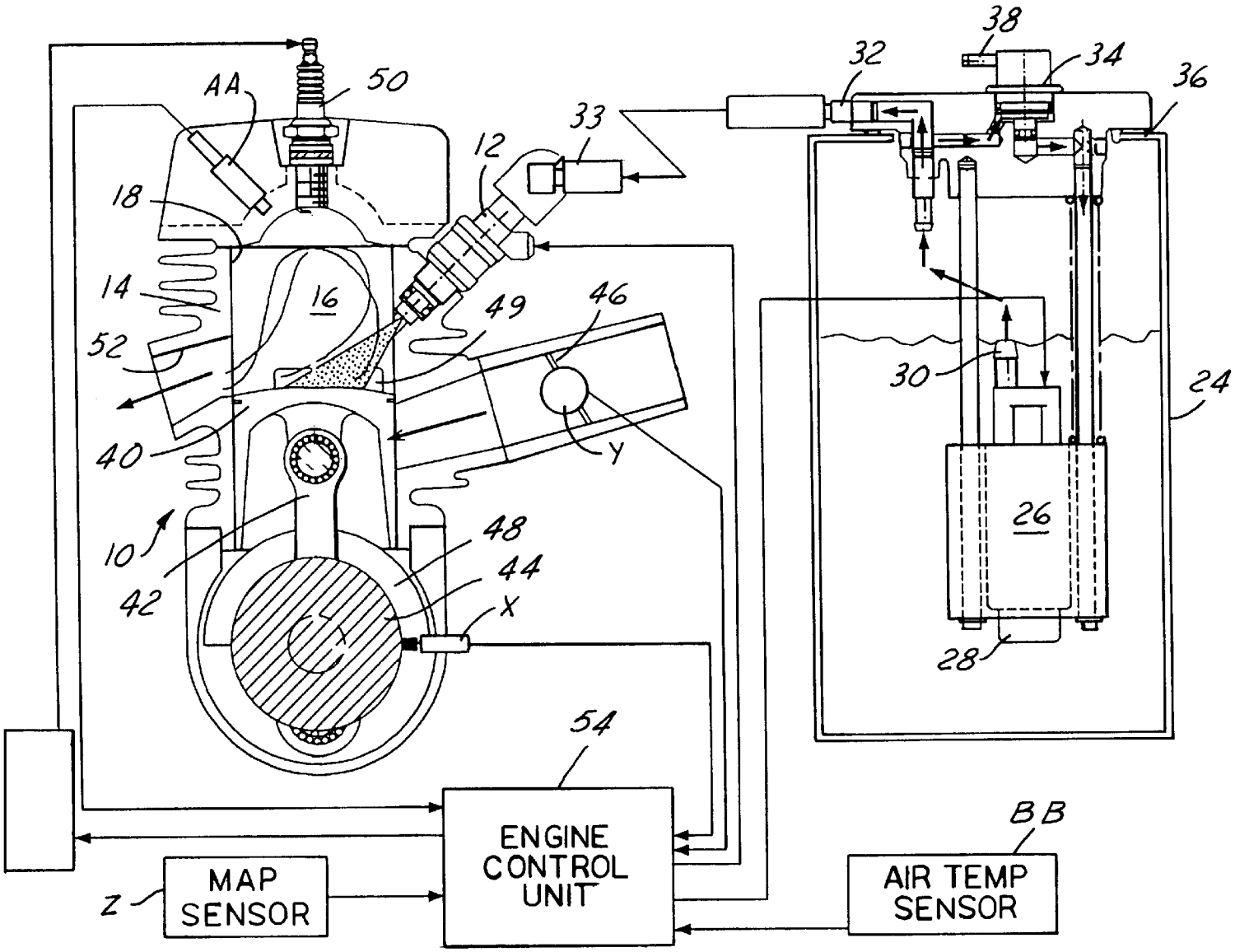
FIG. 1 is a diagrammatic view of a directly injected two-stroke engine.
Figure 2:
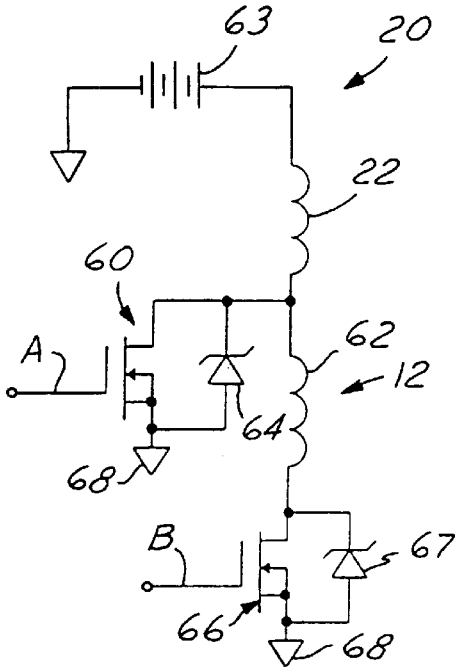
FIG. 2 is a circuit diagram according to the present invention.

Referring in more detail to the drawings, FIG. 1 shows an engine 10 and its associated fuel system which delivers fuel to a fuel injector 12 received through a cylinder wall 14 of the engine 10 to directly inject fuel into the combustion chamber 16 within the piston cylinder bore 18. An electrical drive circuit 20, as shown in FIG. 2, controls the operation of the injector 12 and has an inductor 22 which stores energy and discharges that energy to the injector 12 to more rapidly open the injector 12.

The fuel system has a fuel tank 24 within which is received a fuel pump 26 which has an inlet 28 adjacent the bottom of the fuel tank 24 through which fuel is drawn into the fuel pump 26 and an outlet 30 communicating with an outlet 32 of the fuel tank 24 through which fuel is delivered under pressure to a fuel rail 33 in communication with the fuel injector 12. To control the amount of fuel vapors within the fuel tank 24, a vapor vent valve 34 is partially received in the upper fuel tank wall 36 and preferably has an outlet 38 in communication with a fuel vapor canister (not shown) which contains activated charcoal to absorb at least some of the fuel vapors delivered to the canister and reduce the emission of hydrocarbon vapors into the environment.

The engine 10 has a piston 40 slidably received for reciprocation within the piston cylinder bore 18 and operably connected to a connecting rod 42 which is eccentrically connected to a crankshaft 44. An engine air intake throttle valve 46 communicates with a crankcase chamber 48 of the engine 10 to draw air into the crankcase chamber 48 which is communicated with the combustion chamber 16 through a transfer passage (not shown) and a port 49. Air drawn in through the intake throttle valve 46 provides oxygen to the combustion chamber 16 which is mixed with the fuel injected through the fuel injector 12 to facilitate combustion of the fuel when ignited by a spark plug 50. The reciprocating piston 40 opens and closes an exhaust passage 52 through which the products of the fuel combustion are exhausted.

An engine control unit, such as a microprocessor 54 monitors sensors of various engine operational parameters such as temperature sensors 55, 56, engine crankshaft position sensor 57, intake air flow rate or throttle opening position sensor 59, and manifold air pressure sensor 61 among others, to control the injection of fuel into the engine 10. The microprocessor 54 communicates with a conventional ignition coil 58 to control the timing of the spark plug 50. Further, the microprocessor 54 can be used to control the actuation of the drive circuit 20 which controls the operation of the injector 12.

In a directly injected two-stroke engine 10, an extremely short time is available to inject sufficient fuel into the combustion chamber 16 of the engine 10 especially at high engine speeds which, for a two-stroke engine can be about 12,000 revolutions per minute (RPM's) or more. At high engine speeds, the time available to inject fuel into such an engine can be about 3 milliseconds or less. Further, in a two-stroke engine, the injection occurs once per revolution of the crankshaft 44 as opposed to once every other revolution of the crankshaft 44 in a four-stroke engine. With this reduced time available for the fuel injection event, it is imperative that the fuel injector 12 be rapidly opened so that sufficient fuel may be delivered to the engine 10 to meet its increased fuel demands at high engine speeds and loads.

In a first embodiment, as shown in FIG. 2, an electrical injector drive circuit 20 has an inductor 22 connected in series with the solenoid coil 62 of the fuel injector 12. The power source for the circuit is preferably an alternator supply driven by the engine 10 or a battery 63 of about 12 volts such as those common in automotive vehicles. An inductor driver switch 60 having a control input 65 is connected in series with the inductor 22 across the power source 63, and preferably has a protection diode 64 connected across it to limit the voltage across the switch 60. The inductor driver switch 60 is preferably a transistor such as a MOSFET switch which is common and commercially available. An injector driver switch 66 having a control input 67, which is also preferably a transistor MOSFET switch, is connected in series with the solenoid coil 62 to control the flow of current through the solenoid coil 62 and the opening and closing of the fuel injector valve. Thus, inductor 22, injector coil 62 and injector control switch 66 are connected in series across power source 63. Inductor driver switch 60 is in parallel to the series combination of the solenoid coil 62 and the injector driver switch 66. Preferably, a protection diode 69 is also connected across this switch 66.

When the inductor driver switch 60 is turned on or closed by a control signal at its input 65, current is drawn through the inductor 22 and through the inductor driver switch 60. The current flow through the inductor 22 energizes the inductor 22 and stores electromagnetic energy therein. When the inductor driver switch 60 is turned off and the injector driver switch 66 is turned on by a control signal at its input 67, current flows through the solenoid coil 62 of the fuel injector 12 to open it. In addition to the current supplied from the power source, the collapsing field at the inductor 22 causes the energy stored within the inductor to discharge into the solenoid coil 62, providing an increased current in the coil 62 to more rapidly open the fuel injector valve.

A first control signal at each switch 60, 66 can turn the switches 60, 66 on and a second control signal can turn them off or, preferably, each switch 60, 66 is off in the absence of a control signal at its input 65, 67 and when a control signal is received at an input 65, 67 the associated switch 60, 66 is turned on. Thus, control signals received at the inputs 65, 67 of each switch 60, 66 may be derived from a single control signal from the microprocessor 54 to control the operation of the circuit 20 and each switch 60, 66 can be independently controlled by sending separate control signals to each input 65, 67.

Figure 3A:
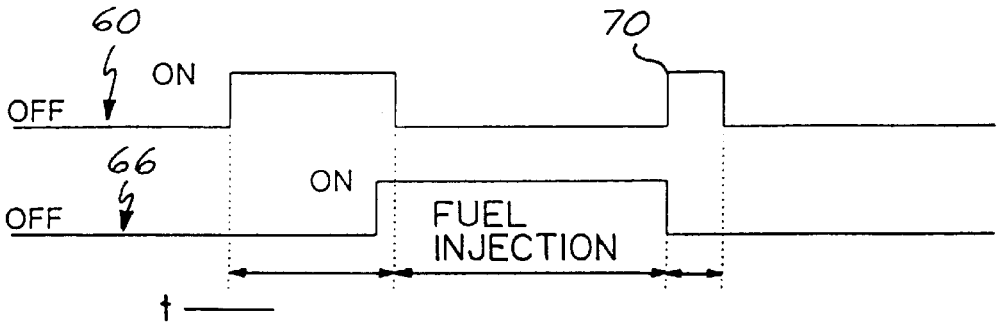
FIG. 3A is a timing diagram illustrating the relation between the inductor driver switch and the injector driver switch.

As shown in the timing diagrams of FIG. 3A, the inductor driver switch 60 is turned on before the injection event begins to precharge or store energy in the inductor 22. The injector driver switch 66 is preferably turned on slightly before the inductor driver switch 60 is turned off, and generally only a few hundred microseconds before the inductor driver switch 60 is turned off. This insures that the injector driver switch 66 is completely on before the energy stored in the inductor 22 is discharged therefrom so that the energy stored in the inductor 22 will flow immediately to the fuel injector coil 62 when the inductor driver switch 60 is turned off. A very small amount of current may flow through the injector coil 62 when the injector driver switch 66 is initially turned on but this does not affect the operation of the injector 12.

Significant current will flow into the solenoid coil 62 when the inductor driver switch 60 is turned off and the injector driver switch 66 is turned on and the inductor acts as a current source in series with the battery 63 to dump a large current into the solenoid coil 62. As the energy in the inductor 22 is dissipated into the solenoid coil 62 the current in the solenoid coil 62 and the inductor 22 reaches a holding level established by the series combination of the solenoid coil 62 and inductor 22. The inductor 22 must have characteristics so that the current in the injector 12 is sufficient to hold the injector 12 open when the currents in the inductor 22 and solenoid coil 62 are at the holding level during the injection event. The opening time of the injector 12 is decreased if the inductor 22 provides an initial peak current in the injector 12 which is higher than the threshold current of the coil 62 required to initially open the injector 12.

Figure 3B:
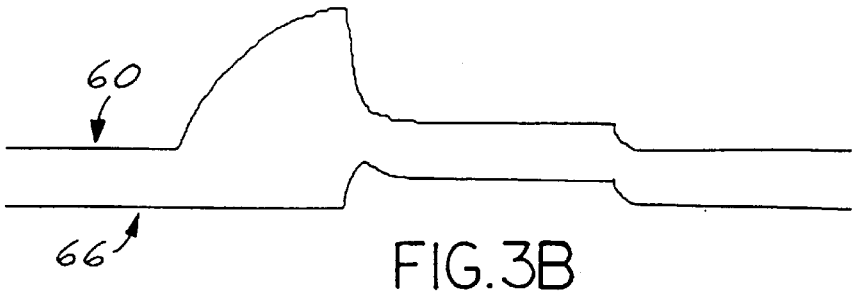
FIG. 3B is a plot of the current of the inductor and the injector coil during an injection event.

When the injector driver switch 66 is turned off, the fall time of the current is controlled by the characteristics of the two coils (inductor 22 and solenoid coil 62) in series. To reduce the time to close the injector 12, the influence of the inductor 22 can be removed by turning the inductor driver switch 60 on until the injector 12 has closed, as indicated at 76 in FIG. 3. Once the injector 12 has closed, the inductor driver switch 60 can be turned off again until the next cycle. Any current in the injector 12 developed at the end of the close time will be minimal and will not affect the proper operation of the injector 12.

In one embodiment, with an injector solenoid coil 62 having a resistance of 15 ohms and an inductance of 11 mHenrys, an inductor 22 having a resistance of 1 ohm and an inductance of 11 mHenrys, protection diodes 64, 67 of 120 volts across both the inductor driver switch 60 and the injector driver switch 66, and a power supply 63 of 12 volts, the time needed to open the injector 12 was decreased to 0.38 milliseconds as compared to an opening time of 1.4 milliseconds for a similar fuel injector 12 without the drive circuit 20. This dramatic reduction in opening time of the injector 12 permits increased fuel flow through the injector 12 during the relatively short time available for fuel injection.

In general, the inductance of the inductor 22 should be as large as possible while minimizing its resistance and size. An inductor 22 with an inductance that is similar to that of the solenoid coil 62 and a resistance that is about between 1/10th to 1/20th of that of the solenoid coil 62 has been experimentally determined to provide the desired results.

Figure 4:
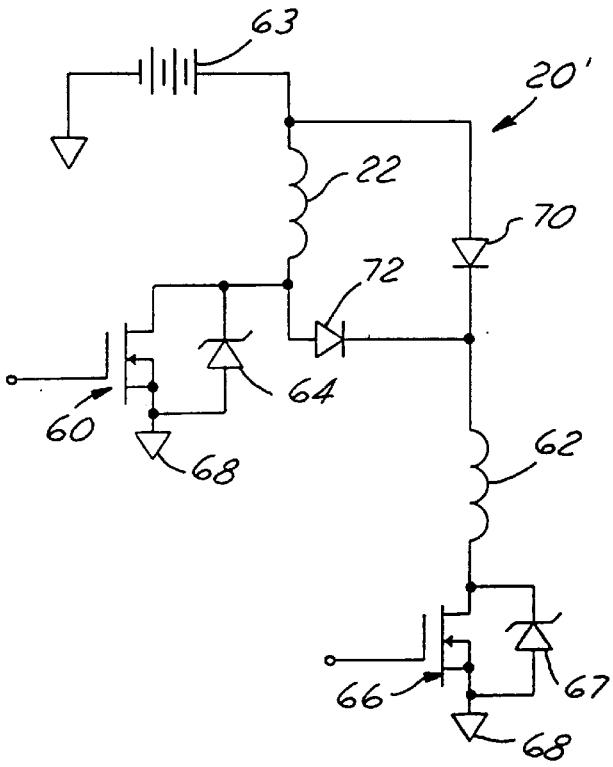
FIG. 4 is a circuit diagram according to an alternate embodiment of this invention.

In another embodiment of the injector drive circuit 20', as shown in FIG. 4, a first current steering diode 72 is connected in series between inductor 22 and injector coil 62, and a second current steering diode 70 is connected across the series combination of inductor 22 and diode 72. The overall function of this drive circuit 20' is essentially the same as that in the first embodiment 20 previously described in that when the inductor driver switch 60 is turned on current flows through the inductor 22 and through the switch 60 to an electrical ground 68 to energize the inductor 22 and store energy therein. However, in this embodiment 20' if the injector driver switch 66 is on simultaneously with the inductor driver switch 60, current may also flow to the solenoid coil 62 through diode 70 to open the injector 12 and inject fuel into the engine 10. In comparison, in the first embodiment 20 if the inductor driver switch 60 is turned on, current will not flow through the injector coil 62. Therefore, in the first embodiment 20, the inductor 22 cannot be energized or precharged to store energy therein while the fuel injector 12 is open. In this second embodiment 20', the inductor 22 may be simultaneously precharged while the injector 12 is open thereby increasing the rate of repetition of the cycle of storing energy and discharging that energy into the injector coil 62 to more rapidly open the injector 12. This is important especially at high engine speeds wherein the engine 10 has an increased fuel demand which requires the injector 12 to remain open for a longer period of time and thereby reduces the time available to charge the inductor 22.

For example, where the time needed to sufficiently precharge the inductor 22 is 4 milliseconds and the maximum injection duration is 7 milliseconds the repeat rate of the energy storage and discharge cycle is improved from 11 milliseconds in the first embodiment (drive circuit 20) to 7.5 milliseconds in the second embodiment (drive circuit 20'). Thus, the repeat rate of the first embodiment drive circuit 20 is suitable for an engine operating up to about 5,500 RPM's and the repeat rate of the second embodiment drive circuit 20' is suitable to control the fuel injection of an engine operating up to about 8,000 RPM's. The repeat rate of the fuel injector drive circuits 20, 20' can be further improved by increasing the flow rate of the injector 12 which will provide a reduced time to inject a given quantity of fuel or by using a lower resistance inductor 22 which would require a shorter precharge time.

The electronic fuel injector drive circuits 20, 20' utilize low cost, common and commercially available electrical components arranged in relatively simple circuitry to provide an increased current to the fuel injector 12 to more rapidly open it. This provides increased control over the fuel injection event and is especially desirable for use with directly injected two-stroke engines which have a significantly reduced available time for fuel injection. The drive circuits 20, 20' are considerably less expensive and more effective than peak and hold or saturation type injector drivers. Further, currently available microprocessors 54 which monitor various engine operational perimeters can be readily adapted to control the inductor driver switch 60 and the injector driver switch 66 in use to more efficiently operate the drive circuits 20, 20', fuel system and engine 10. Through electronic switching, an energy storage device (inductor 22) is first caused to store energy, and then connected in series with the vehicle power source to discharge into the injector coil. Thus, there is no need for an elevated voltage supply to provide rapid injection opening, as has been purposed in the art.

I claim:

1. A drive circuit for energizing an engine fuel injector coil from a power source, comprising:

energy storage means responsive to a first control signal for selectively storing energy from the power source, wherein said energy storage means includes an inductor and a first switch that is responsive to the first control signal to draw current through the inductor from the energy source; and switch means responsive to a second control signal for selectively discharging energy stored in the energy storage means into the injector coil, wherein said switch means includes a switch for connecting in series with the injector coil to control the flow of current from the power source and said inductor through the injector coil;

wherein said inductor has a resistance of less than about 5 ohms and an inductance of about between 5 to 20 mHenry's.

2. A drive circuit for energizing an engine fuel injector coil from a power source, comprising:

energy storage means responsive to a first control signal for selectively storing energy from the power source, wherein said energy storage means includes an inductor and a first switch that is responsive to the first control signal to draw current through the inductor from the energy source; and switch means responsive to a second control signal for selectively discharging energy stored in the energy storage means into the injector coil, wherein said switch means includes a switch for connecting in series with the injector coil to control the flow of current from the power source and said inductor through the injector coil;

wherein said inductor has a resistance of between about 0.1 and 0.05 that of the injector coil.

3. A drive circuit for energizing an engine fuel injector coil from a power source, comprising:

an energy storage device for coupling to the power source to store energy when current from the power source flows through the storage device;

a first switch coupled to the storage device, said first switch having a conductive state which permits current flow through said first switch and having a non-conductive state which prevents current flow through said first switch;

a second switch for switching current through the injector coil, said second switch having a conductive state which permits current flow through said second switch and having a non-conductive state which prevents current flow through said second switch;

an electronic control unit having a first output coupled to said first switch and a second output coupled to said second switch, said microprocessor providing a first control signal on said first output to place said first switch in either said conductive or non-conductive states and providing a second control signal on said second output to place said second switch in either said conductive or non-conductive state;

wherein, when said drive circuit is connected to the power source and injector coil:

said first switch is operable in its conductive state to draw current through said energy storage device to thereby store energy in said storage device;

said second switch is operable in its conductive state to draw current through the injector coil; and said storage device is coupled to the injector coil to supply its stored energy to the injector coil when said first switch is in its non-conductive state and said second switch is in its conductive state;

wherein said microprocessor is operable to place said first switch in its conductive state and said second switch in its non-conductive state to thereby store energy in said storage device, and wherein said microprocessor is operable to then switch said second switch to its conductive state and to thereafter switch said first switch to its non-conductive state, whereby said second switch is placed in its conductive state prior to discharging of energy stored in said storage device.

4. A drive circuit as defined in claim 3, wherein said storage device comprises an inductor.

5. A drive circuit as defined in claim 4, wherein said inductor has a resistance of between about 0.1 to 0.05 that of the injector coil.

6. A drive circuit as defined in claim 4, further comprising a current steering diode connected in circuit to provide a current path in parallel with said inductor.

7. A drive circuit as defined in claim 4, wherein said first and second switches comprise MOSFETs.

8. A drive circuit for energizing an engine fuel injector coil from a power source, comprising:

an energy storage device for coupling to the power source to store energy when current from the power source flows through the storage device;

a first switch coupled to the storage device, said first switch having a conductive state which permits current flow through said first switch and having a non-conductive state which prevents current flow through said first switch;

a second switch for switching current through the injector coil, said second switch having a conductive state which permits current flow through said second switch and having a non-conductive state which prevents current flow through said second switch;

an electronic control unit having a first output coupled to said first switch and a second output coupled to said second switch, said microprocessor providing a first control signal on said first output to place said first switch in either said conductive or non-conductive states and providing a second control signal on said second output to place said second switch in either said conductive or non-conductive state;

wherein, when said drive circuit is connected to the power source and injector coil:

said first switch is operable in its conductive state to draw current through said energy storage device to thereby store energy in said storage device;

said second switch is operable in its conductive state to draw current through the injector coil; and said storage device is coupled to the injector coil to supply its stored energy to the injector coil when said first switch is in its non-conductive state and said second switch is in its conductive state;

wherein, when said drive circuit is connected to the power source and injector coil, said microprocessor is operable to place said first switch in its conductive state and said second switch in its non-conductive state to thereby store energy in said storage device, and wherein said microprocessor is operable to then switch said second switch to its conductive state and said first switch to its non-conductive state to thereby discharge energy stored in said storage device into the injector coil and further, wherein said microprocessor is operable to de-energize the injector coil by switching said first switch to its conductive state, switching said second switch to its non-conductive state, and thereafter switching said first switch back to its non-conductive state.

9. A drive circuit as defined in claim 8, wherein said storage device comprises an inductor.

10. A drive circuit as defined in claim 9, wherein said inductor has a resistance of between about 0.1 to 0.05 that of the injector coil.

11. A drive circuit as defined in claim 9, further comprising a current steering diode connected in circuit to provide a current path in parallel with said inductor.

12. A drive circuit as defined in claim 9, wherein said first and second switches comprise MOSFETs.

* * * * *